US009347718B2

(12) United States Patent
Watson

(10) Patent No.: US 9,347,718 B2
(45) Date of Patent: May 24, 2016

(54) APPARATUS FOR CLEANING TUBES OF A HEAT EXCHANGER

(75) Inventor: Michael Watson, Rayleigh (GB)

(73) Assignee: Michael Watson, Essex (GB)

( * ) Notice: Subject to any disclaimer, the term of this patent is extended or adjusted under 35 U.S.C. 154(b) by 1085 days.

(21) Appl. No.: 13/500,390

(22) PCT Filed: Oct. 7, 2010

(86) PCT No.: PCT/IB2010/054545

§ 371 (c)(1),
(2), (4) Date: Apr. 5, 2012

(87) PCT Pub. No.: WO2011/042883

PCT Pub. Date: Apr. 14, 2011

(65) Prior Publication Data

US 2012/0204914 A1 Aug. 16, 2012

(30) Foreign Application Priority Data

Oct. 9, 2009 (GB) ..... 0917701.5

(51) Int. Cl.
*F28G 15/04* (2006.01)
*F28G 3/16* (2006.01)

(52) U.S. Cl.
CPC ..... *F28G 3/163* (2013.01); *F28G 15/04* (2013.01)

(58) Field of Classification Search
CPC ..... F28G 15/04
See application file for complete search history.

(56) References Cited

U.S. PATENT DOCUMENTS

| | | | |
|---|---|---|---|
| 3,195,165 | A | 7/1965 | Matthews |
| 5,605,117 | A | 2/1997 | Moskal |
| 2004/0194246 | A1 | 10/2004 | Zalewski |

FOREIGN PATENT DOCUMENTS

| | | | |
|---|---|---|---|
| EP | 2034266 | A2 * | 3/2009 |
| GB | 980 843 | | 1/1965 |

OTHER PUBLICATIONS

Jaresch, Dirk, Mar. 2009, EP 2034266A2, English machine translation.*
International Search Report issued in PCT/IB2010/054545 mailed Feb. 2, 2011.

* cited by examiner

*Primary Examiner* — Jason Ko
(74) *Attorney, Agent, or Firm* — Foley & Lardner LLP

(57) ABSTRACT

An apparatus is disclosed for supporting, rotating and advancing a rigid lance when cleaning the interior of a tube of a heat exchanger. The apparatus comprises a longitudinally extending aluminium body 10 defining a closed conduit 12 and a C-shaped channel 14 sharing a common partition wall and a rigid lance is located within the C-shaped channel. A first motor assembly 20 rotates the lance 26 and feeds water under pressure into the lance 26 through a rotary coupling 30. The first motor assembly 20 is slidable along, and guided by, the C-shaped channel 14, by a second motor assembly 30 which serves to advance and retract the lance 26. The second motor assembly 30 is connected to pull the first motor assembly in both directions along the C-shaped channel by a flexible drive element 34 having a run housed in the closed conduit 12.

8 Claims, 1 Drawing Sheet

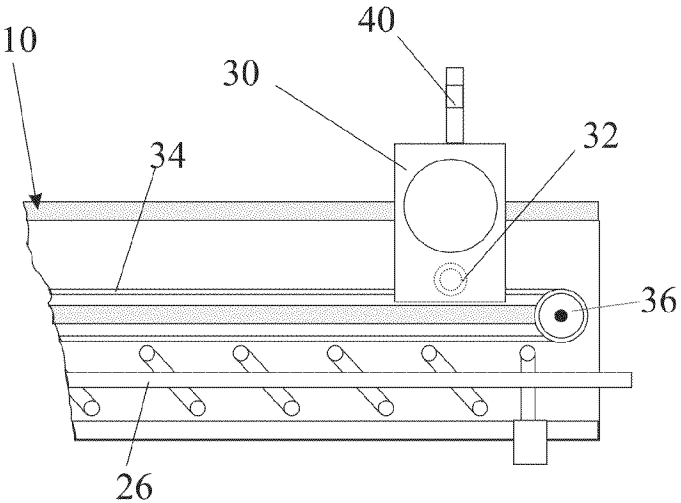
Fig. 1
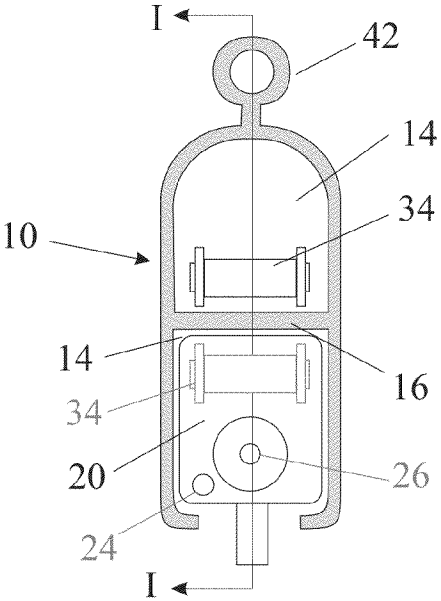
Fig. 2
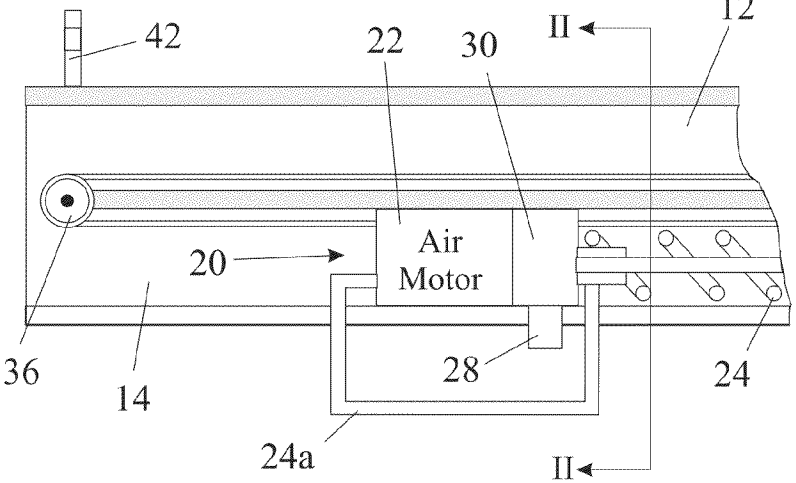

APPARATUS FOR CLEANING TUBES OF A HEAT EXCHANGER

CROSS-REFERENCE TO RELATED APPLICATIONS

The present application is a U.S. national stage application claiming the benefit of International Application No. PCT/IB2010/054545, filed on Oct. 7, 2010, which in turn claims priority to GB 0917701.5, filed Oct. 9, 2009, the entire contents of which are incorporated herein by reference in their entirety.

FIELD OF THE INVENTION

The present invention relates to apparatus for cleaning the interior of the tubes of a heat exchanger core.

BACKGROUND OF THE INVENTION

In chemical processing plants, such as oil refineries, extensive use is made of heat exchangers. In some heat exchangers, the tubes are arranged horizontally, often at some height above the ground, and in other cases they are arranged vertically.

In use, over time, a deposit tends to build up on the inner surfaces of the tubes, the nature of the deposit depending on the fluid flowing through the tubes. The build up of deposit increases flow resistance and reduces the thermal conductivity of the walls of the tube, both effects reducing the efficiency of the heat exchanger.

When efficiency drops to an unacceptable level, the interior of the tubes of the core has to be cleaned. This is usually carried out by high pressure jetting. After access is gained to the ends of the tubes, for example by removing a header or an access plate in a header, a lance emitting jets of water at high pressure is inserted into the tube and advanced along its length. The process is repeated for each of the tubes until the entire core is cleaned.

Often, it suffices to use a flexible lance that can simply be advanced into the tube by hand. However, for harder deposits, it is sometimes necessary to use a rigid lance and to rotate the lance as it is being advanced into each tube. As the lance may be several meters long, special apparatus is needed to support and advance the lance.

Existing apparatus used for this purpose comprises a rigid beam resembling an RSJ (roller steel joist). A carriage slidable along the top of the beam comprises a motor and a gearbox for rotating the lance as well as a rotary coupling for feeding water under high pressure into the lance while allowing it to rotate. The lance itself passes through a hole in each of a series of guide plate that are themselves slidable along the top of the beam and spaced apart by springs. These plates are needed to stop the lance from bowing as it rotates.

The major problem presented by existing apparatus for supporting and advancing a rotating rigid lance is one of weight. The apparatus is too heavy to be raised to the height of the tube to be cleaned without the use of a hoist or a crane. Furthermore, in order to position the entire apparatus in correct alignment with the tube to be cleaned, it is necessary to construct scaffolding. The weight of the apparatus also adds to the cost of its transportation.

SUMMARY OF THE INVENTION

With a view to mitigating the foregoing disadvantage of the prior art, the present invention provides an apparatus for supporting, rotating and advancing a rigid lance, comprising a longitudinally extending aluminium body defining a closed conduit and a C-shaped channel sharing a common partition wall, a rigid lance located within the C-shaped channel, a first motor assembly for rotating the lance and feeding water under pressure into the lance through a rotary coupling, the first motor assembly being slidable along, and guided by, the C-shaped channel, and a second motor assembly serving to advance and retract the lance, the second motor assembly being connected to pull the first motor assembly in both directions along the C-shaped channel by a flexible drive element having a run housed in the closed conduit.

The aluminium body is preferably made from a commonly available extrusion which is used in making yacht masts. In that application, the C-shaped channel receives runners connected to a sail and the closed conduit contains the rope used to raise and lower the sail. The main advantage of using such a construction for the aluminium body of the apparatus of the present invention is its lightness. Furthermore, the fact that the lance is located within the C-shaped channel makes it possible to dispense with movable guide plates. Bowing of the lance as it rotates is restricted by the walls of the C-shaped channel.

It is preferred to supply air to the first motor assembly that acts to rotate the lance by way of a hose housed in the C-shaped channel and coiled around the lance. Apart from keeping the air hose neat, this further constrains the bowing of the lance and prevents the noise that would be caused by a bowing lance contacting the inner walls of the C-shaped channel.

The flexible drive element is preferably a chain passing over two guide sprockets at the opposite ends of the aluminium body.

The second motor assembly that moves the first motor assembly by way of the flexible drive element is advantageously located as near to the operating end of the apparatus, that is to say the end from which the lance projects.

To allow the tubes of elevated heat exchanger cores to be cleaned, a gantry is provided near the end of the heat exchanger core comprising a runway on which service personnel can stand. With conventional apparatus for cleaning tubes using a rigid rotating lance, scaffolding needs to be erected adjacent this runway and the apparatus is raised onto the scaffolding by a crane. The entire length of the reinforcing beam of the apparatus is supported on the scaffolding so that the lance is centred on and axially aligned with the tube to be cleaned.

By contrast, the apparatus of the invention is sufficiently light to be carried manually up to the level of the runway. A block and tackle or a hoist attached to the gantry suffices to support the front end of the apparatus in a position in which the lance is centred on the tube to be cleaned. The rear end of the apparatus, which can overhang the runway, can be supported by two cables that are also anchored at their opposite ends to the gantry. By lengthening and shortening the two cables by equal amounts, the rear end of the apparatus can be raised and lowered and by shortening one cable while lengthening the other the apparatus can be moved from left to right. In this way, the apparatus can be correctly aligned with the tube being cleaned by personnel standing on the runway without the need to erect any support scaffolding.

By placing the second motor assembly near the operating end of the apparatus, the centre of gravity of the apparatus is moved nearer to the gantry, placing less stress on the two cables used to align the lance with the tube to be cleaned and reducing the effort required in setting up the apparatus.

A further advantage of the aluminium body of the apparatus of the invention is that its strength is not compromised if is made in sections that are assembled to one another on site. This can considerably reduce the cost of transporting the apparatus to the chemical processing plant where it is needed. In a case of urgency, the sections of the apparatus may even be carried as luggage on an aircraft instead of needing to be shipped in container.

Another important advantage of the invention is that most of the moving parts are contained within the aluminium body. This reduces the risk of injury. In particular, the flexible drive element connected to the first motor assembly is not exposed and the rotating lance itself is almost completely encased.

BRIEF DESCRIPTION OF THE DRAWINGS

The invention will now be described further, by way of example, with reference to the accompanying drawings, in which:

FIG. 1 is a section through an apparatus of the invention taken in the plane I-I in FIG. 2, and FIG. 2 is a section in the plane II-II in FIG. 1.

DETAILED DESCRIPTION OF THE PREFERRED EMBODIMENT

The apparatus of the invention comprises a body 10 formed of an aluminium extrusion of which the section is shown in FIG. 2. The body 10 includes a closed conduit 12 and a C-shaped channel 14 which share a common partition wall 16.

A first motor assembly 20 is slidable along the C-shaped channel 14. The assembly 20 comprises an air motor 22 supplied with air through a flexible hose 24. The motor serves to rotate a lance 26 which is fed with water through a high pressure hose (not shown) fitted to a connector 28. The assembly 20 includes a rotary fluid coupling 30 so that water under pressure can be fed into the lance 26 as it is being rotated by the air motor 22.

The air hose 24 supplying air to the air motor is arranged in the C-shaped channel 14 and is coiled around the lance 26. As the assembly 20 slides along the C-shaped channel 14, the coils of the hose 24 separate and gather together but at all times provide a shield or buffer between the lance 26 and the walls of the C-shaped channel 14. The coiled flexible hose 24 is connected through a rigid tube 24*a* to the air input connector of the air motor 22.

A second motor assembly 30 is provided to move the first motor assembly 20 along the C-shaped channel 14. The second motor assembly is mounted in a fixed position near the operating end of the apparatus and has a sprocket 32 that drives a chain 34 of which the opposite ends are connected to the first motor assembly 20. The chain 34 also passes over two idler sprockets 36 arranged level with the partition wall 16, one at each end of the apparatus 10.

As the motor 30 rotates the sprocket 32 in one direction, the lance 26 is advanced into the tube to be cleaned and when the direction of rotation of the sprocket 32 is reversed the lance 26 is retracted.

Eyelets 40 and 42 are provided near the opposite ends of the apparatus to permit it to be suspended from a gantry and to be aligned with the axis of the tube being cleaned.

In use, the apparatus is sufficiently light to be carried manually up to the level of the end of the heat exchanger tube to be cleaned. A wire attached to a gantry is connected to the eyelet 40 at the operating end of the apparatus and is used to support the weight of the apparatus 10 and to raise it to the level of the tube to be cleaned, Two wires are connected to the eyelet 42 at the opposite end of the apparatus and these are used to support its rear end as it is swung to overhang the runway on which the personnel are standing. The two wires can now be adjusted in length to align the lance 26 with the axis of the tube to be cleaned both in the horizontal and in the vertical plane.

With the lance now correctly aligned, high pressure water is fed to the lance 26 and compressed air is fed to the air motor 22 through the coiled hose 24 to rotate the lance. The motor 30 is then switched on to move the air motor assembly 20 along the C-shaped channel 14 and at the same time to advance the lance 26 into the heat exchanger core. A slipping clutch in the second motor assembly 30 ensures that excessive force is not applied to drive the lance 26 into the heat exchanger tube.

If a compressive force is applied to the ends of the lance, it will tend to bow as it rotates. However, the bowing is limited by the side walls of the C-shaped channel 14 but before coming into contact with these side walls, the lance will contact the coils of the hose 24. The hose will thus help prevent the lance from bowing and will prevent the lance from banging against the side walls of the C-shaped channel 14.

If it is desired to cover the open mouth of C-shaped channel 14, a folded strip 50 may be used as shown in the drawing.

To assist in transportation, the aluminium extrusion may be formed of sections that are securable to each other end to end.

The invention claimed is:

1. An apparatus for supporting, rotating and advancing a rigid lance, comprising a longitudinally extending aluminium body defining a closed conduit and a C-shaped channel sharing a common partition wall, a rigid lance located within the C-shaped channel, a first motor assembly for rotating the lance and feeding water under pressure into the lance through a rotary coupling, the first motor assembly being slidable along, and guided by, the C-shaped channel, and a second motor assembly serving to advance and retract the lance, the second motor assembly being connected to pull the first motor assembly in both directions along the C-shaped channel by a flexible drive element having a run of chain housed in the closed conduit.

2. An apparatus as claimed in claim 1, wherein the aluminium body is formed as an extrusion.

3. An apparatus as claimed in claim 1, wherein an air hose is housed in the C-shaped channel and coiled around the lance to supply compressed air to the first motor assembly for rotating the lance.

4. An apparatus as claimed in claim 1, wherein the flexible drive element is a chain passing over two guide sprockets at the opposite ends of the aluminium body.

5. An apparatus as claimed in claim 1, wherein the second motor assembly for moving the first motor assembly by way of the flexible drive element is located at or near the operating end of the apparatus.

6. An apparatus as claimed in claim 1, wherein two suspension points are provided on the upper side of the apparatus, one near the operating end of the apparatus and the other spaced along its length.

7. An apparatus as claimed in claim 1, wherein the aluminium body is formed of sections that are separable from one another to assist transportation of the apparatus.

8. An apparatus for supporting, rotating and advancing a rigid lance, comprising a longitudinally extending aluminium body defining a closed conduit and a C-shaped channel sharing a common partition wall, a rigid lance located within the C-shaped channel, a first motor assembly for rotating the lance and feeding water under pressure into the lance through a rotary coupling, the first motor assembly being slidable along, and guided by, the C-shaped channel, and a second motor assembly being fixed relative to the aluminium body and serving to advance and retract the lance, the second motor assembly being connected to pull the first motor assembly in both directions along the C-shaped channel by a flexible drive element having a run of chain housed in the closed conduit.

* * * * *